US005980660A

United States Patent [19]

Garat et al.

[11] Patent Number: 5,980,660

[45] Date of Patent: Nov. 9, 1999

[54] METAL ALLOY MASS FOR FORMING IN THE SEMISOLID STATE

[75] Inventors: Michel Garat, St. Quentin sur Isere; Christian Pluchon, Voiron; Willem Loue, Chirens; Michel Brimont; Marc Tavernier, both of Coublevie Cidex, all of France

[73] Assignee: Aluminium Pechiney, Courbevoie, France

[21] Appl. No.: 08/792,300

[22] Filed: Feb. 3, 1997

[30] Foreign Application Priority Data

Feb. 1, 1996 [FR] France ..... 96 01442

[51] Int. Cl.[6] ..... C22C 21/00

[52] U.S. Cl. ..... 148/549; 148/538; 148/688; 148/437; 420/528

[58] Field of Search ..... 148/549, 538, 148/688, 437; 420/528

[56] References Cited

U.S. PATENT DOCUMENTS 4,621,676 11/1986 Steward ..... 164/485

4,804,034 2/1989 Leatham et al. ..... 164/46

OTHER PUBLICATIONS

Conf. Light Metals Adv. Prod. Fabr. (1992) p. 399–411 (Ghosh et al.) Montreal Canada (abstract), 1992.

*Primary Examiner*—Patrick Ryan
*Assistant Examiner*—M. Alexandra Elve
*Attorney, Agent, or Firm*—Dennison, Meserole, Scheiner & Schultz

[57] ABSTRACT

A metal alloy mass of a defined porosity for forming in the semi-solid state. When the porosity is measured by cooling in ambient air from a temperature corresponding to a liquid fraction ratio between 30 and 70% to the ambient temperature, the mass has a porosity ratio, measured by image analysis, between 2 and 20%, and preferably between 3 and 8%. Alternatively, when the gassing level is measured by a solidification test under 80 hPa, the mass has a volumetric porosity ratio between 3 and 50% and preferably between 4 and 25%.

10 Claims, No Drawings

METAL ALLOY MASS FOR FORMING IN THE SEMISOLID STATE

FIELD OF THE INVENTION

The invention relates to the field of the forming of metal alloys in the semisolid state, that is, at a temperature between the solidus and the liquidus of the alloy, which metal alloys have thixotropic properties in this semisolid state. This forming in the semisolid state can be a "rheoforming," a process in which a semisolid metal alloy mass of any shape is produced by casting liquid metal under specific conditions, then immediately formed by forging, extrusion or pressure injection, a derivative of die casting.

It can also be a "thixoforming," a process more widely used industrially, in which a solid semifinished product, for example a billet, is prepared, and this semifinished product or a piece derived from this semifinished product is reheated to the semisolid state and formed by extrusion, forging or pressure injection.

DESCRIPTION OF THE RELATED ART

The forming of metal alloys in the semisolid state developed from the discovery made in the early 1970s by Prof. FLEMINGS' team at MIT that a metal melted under certain particular conditions and reheated to the semisolid state has an apparent viscosity which is dependent on the time and the shear rate. Thus, this viscosity can vary from $10^9$ Pa.s at rest, which makes it possible to manipulate it like a solid during handling, to 1 Pa.s under high shear, which allows it to be injected into a mold like a viscous liquid.

In order to have these properties, the metal must be solidified with a particular structure, either a globular structure, which may be obtained either by mechanical agitation as in Prof. FLEMINGS' initial patents, or by electromagnetic stirring, for example as in the ITT-ALUMAX patents U.S. Pat. No. 4,434,837 and U.S. Pat. No. 4,457,355, or the ALUMINIUM PECHINEY patents EP 0351327 and EP 0439981, or a very fine equiaxial dendritic structure allowing globularization upon reheating to the semisolid state, which is obtained through the addition of a grain refiner to the alloy and through particular casting conditions.

The article written by M. P. KENNEY et al. in Volume 15, "Casting", of the Metals Handbook, 9th edition, 1989, edited by the American Society of Materials, pp. 327–338, entitled "Semisolid Metal Casting and Forging" presents a fairly complete summary of this technique, which applies to ferrous alloys and non-ferrous alloys such as Zn, Mg, Cu and Ti alloys as well as to Ni or Co based superalloys, but which has been commercially developed primarily for aluminum casting alloys.

The principal advantages of forming in the semisolid state are linked to the ease of handling the alloys, which behave like solids and can therefore be handled by means of automatic installations of the carousel type, to the low injection pressure due to the quasi-liquid behavior under high shear, to the thermal gain due to the fact that it is not necessary to heat until a complete melting is achieved, and finally to the quality of the pieces obtained, which are free from cavities and segregation, with the potential to produce thin walls with laminar filling.

These advantages are all the more pronounced the lower the viscosity under high shear, that is, the nearer the behavior can be to that of a liquid while retaining a solid behavior at rest.

On the other hand, from the beginning of the commercial development of thixotropic alloys, suppliers have made every effort to keep the porosity of the metal due to gasses as low as possible, as they normally do for conventional quality alloys, since porosity is presumed to harm the metallurgic strength of the pieces produced. For instance, the article in the Metals Handbook mentioned above indicates that in products obtained by forging in the semisolid state, porosity due to gasses is quite infrequent, that it stems from excessive gate speeds creating excessive turbulence in the metal flux and trapping the atmosphere of the mold, and that it can be avoided by reducing this speed. This clearly shows that such a porosity is not desirable.

The gassing level of the metal can be estimated in the liquid metal by means of a density measurement called $d_{80}$. It consists of sampling, with the aid of a cup, a small quantity of liquid metal, of introducing it into a vacuum bell jar where it will slowly solidify under a residual pressure of 80 hPa, and of measuring its density with the aid of precision scales. The less gas the liquid metal contains, the higher its density.

In the case of aluminum alloys, the specifications for thixotropic billets recommend minimal values for the $d_{80}$ density; for example, for an alloy with 7% silicon and 0.6% magnesium, $d_{80}>2.60$ is established for a theoretical density of 2.67, that is, a volumetric porosity ratio of the sample, solidified under 80 hPa, as defined by the equation $(d_{th}-d_{80})/d_{th}<2.62\%$.

SUMMARY OF THE INVENTION

The inventors unexpectedly discovered that in the case of semisolid forming, non-compliance with these specifications, that is, a higher level of gassing, not only did not result in the anticipated drawbacks as to the metallurgic soundness of the pieces produced, but led to quite a substantial reduction in the apparent viscosity at high shear of the blank reheated to the semisolid state, resulting on the contrary in a better quality of forged or pressure-injected pieces which were free from any porosity, even after subsequent heat treatment. Moreover, the elongation of the finished pieces was increased without reducing their tensile strength or yield strength, and the dispersion of the elongations was sharply reduced.

Thus, the subject of the invention is a metal alloy mass for forming in the semisolid state, cast from liquid metal in which the gassing level, measured by solidification test under a reduced pressure of 80 hPa, is such that the volumetric porosity ratio a $(d_{th}-d_{80})/d_{th}$ is between 3 and 50%, and preferably between 4 and 25%. In the case of rheoforming, this metal mass is cast in the semisolid state and immediately formed to obtain the finished piece. In the case of thixoforming, it is cast in the semisolid state in the form of a semifinished product, for example a rough forging or an extrusion billet, or a billet which will be cut into cylindrical blanks for pressure injection.

Another subject of the invention is a metal alloy mass for forming in the semisolid state which, after having been cooled in ambient air from a temperature corresponding to a liquid fraction ratio between 30 and 70% to the ambient temperature, has a volumetric porosity ratio p, measured by image analysis at mid-distance between the center of the mass and its external surface, between 2 and 20%, and preferably between 3 and 8%.

In the case of rheoforming, the mass is obtained in the semisolid state directly from the casting. In the case of thixoforming, the metal mass is derived from the solid semifinished product obtained from the casting (ingot, billet or blank), reheated to the semisolid state, to a temperature corresponding to a liquid fraction ratio between 30 and 70%. For the measurement of the porosity ratio p, the heating time used is t (in min)=2.56 $(V/S)^2$, V/S being the ratio of the volume of the alloy mass to its external surface area, a ratio measured in cm. In the frequent case in which the mass has a cylindrical shape, t=0.16 $D^2$, D being the diameter of the cylinder in cm.

The invention particularly applies to aluminum alloys, and more particularly to AlSi alloys containing from 3 to 30% Si, and possibly other alloying elements such as copper or magnesium.

DETAILED DESCRIPTION OF THE INVENTION

Except for specific measurements for obtaining the controlled porosity ratio, the fabrication of thixotropic metal according to the invention is carried out in the usual way, for example, for thixoformed billets, by vertical casting in batches with pseudotoric agitating by means of three-phase traveling-field linear motors according to the process described in the patents EP 0351327 and EP 0439981. But the metal masses can also be produced by mechanical agitation during solidification, using static mixer-coolers or other electromagnetic agitating methods such as that described in the patents U.S. Pat. No. 4,434,837 and U.S. Pat. No. 4,457,355. Finally, they can be produced without stirring from a metal which contains a grain refiner (for example $TiB_2$, for aluminum alloys), under specific casting conditions, as described for example in the patent application WO 96/32519.

The standard means for treating liquid metal (filtration, rotary injector ladle) may be used to ensure the inclusionary purity and the structural homogeneity of the cast metal.

In order to obtain the controlled porosity ratio according to the invention, a predetermined quantity of a gas which is soluble in the bath and incapable of chemically reacting with it is introduced into the liquid metal, ensuring a fine and homogeneous dispersion of the gas bubbles. The gas best suited for this purpose is hydrogen, which can possibly be mixed with a neutral gas such as nitrogen or argon.

It is also possible to use fluxes based on hydrous salts as the source of hydrogen.

Another method consists of introducing the hydrogen using the treatment ladle, which is generally placed between the holding furnace and the casting bay, for example a ladle equipped with a rotary nozzle gas injector, such as the ALPUR® ladle sold by the company PECHINEY RHENALU. In this case, instead of injecting only a neutral gas such as argon or nitrogen, a certain proportion of hydrogen is mixed with the neutral gas. A static gas bubble-through device can also be used. The gassing of the metal can be facilitated by maintaining a pressure greater than the atmospheric pressure during the treatment.

In order to maintain a gassing level which is as constant as possible during the casting of the billets, the injection of the gas or the gaseous mixture is preferably carried out continuously.

The gassing level of the liquid metal can be estimated by means of the $d_{80}$ density measurement described above. In the case of an aluminum alloy with 7% Si and 0.6% Mg, whose theoretical density in the absence of porosity is 2.67, the suppliers' specifications indicate a $d_{80}$>2.60, which corresponds to a porosity ratio a=(2.67−2.60)/2.67=2.62%. In order to obtain the properties of the invention, this ratio a must be greater than 3%, and preferably 4%, and it is only above 50% that there is a risk of harmful porosities appearing in the forged or pressure-injected piece. However, it is preferable to keep it below 25%.

It is also possible to measure the porosity of an alloy mass intended for forming in the semisolid state in a sample cooled by convection of ambient air from the forming temperature, which corresponds to a liquid fraction ratio between 30 and 70% and preferably near 50%, to the ambient temperature. In the case of thixoforming, the solid semifinished product must first be reheated to the forming temperature for a nominal time t=2.56 $(V/S)^2$, t being expressed in min, V being the volume of the metal mass in $cm^3$ and S being its external surface area in $cm^2$. In the most frequent industrial case in which the initial semifinished product is a blank cut from a cylindrical billet with a diameter D, the formula is written t=0.16 $D^2$ when D is expressed in cm, or t=$D^2$ when D is expressed in inches, which is normal in the art for aluminum alloys.

For the measurement of p, an image analysis method is used which consists of taking samples at the approximate mid-distance between the geometric center of the alloy mass and its external surface, that is, at mid-height and mid-radius in the case of a mass with a cylindrical shape such as a blank cut from a billet, then performing an image analysis on micrographs produced on a smooth surface without a chemical attack on the sample. The white parts represent the globules, the grey parts the eutectic, and the black parts the porosities. The resolution must be such that pores with a size >10 $\mu$m are taken into account. The measurement is repeated on at least 25 fields of the sample spread over 360°, until the average of the surface fractions stabilizes.

It is noted that the viscosity reduction properties appear as soon as the volumetric porosity ratio exceeds 2%, and that above 20%, porosities appear in the forged or pressure-injected pieces. These ratios are the actual gassing porosity ratios in the metal at the stage of its industrial use through extrusion, forging or die-casting.

The chief result linked to the utilization of the metal according to the invention consists of a spectacular lowering of the apparent viscosity of the metal mass in the semisolid state, all other parameters being similar, particularly the microstructure.

The rheological test which measures this apparent viscosity is a penetration test which consists of measuring the yield strength F of the metal mass in the semisolid state, compressed by a tool at a constant speed at the end of a stroke of predetermined length. The ratio of this force F to a constant force threshold $F_s$ is established for a conventional value of metal loss by exudation of 8%, metal loss being an indicator of the temperature, and thus of the liquid fraction ratio for a given material.

In the case of AlSi aluminum alloys, a reduction of more than 40% in the ratio $F/F_s$ is observed. It is also observed that, in spite of the increase in porosity of the reheated blank, the metallurgic soundness of the forged or pressure-injected pieces is at least as good as with degassed metal, and the mechanical properties are at least equivalent, with elongation even being increased, without reducing strength. Moreover, this elongation is better controlled, as statistical dispersion is sharply reduced.

Furthermore, welding tests using the TIG and MIG processes made it possible to verify that the utilization of an alloy treated according to the invention did not cause any porosity in the welding bead or in the heat-affected area, thus allowing the production of pieces welded with an alloy of this type.

EXAMPLE

An aluminum alloy A-S7G0.6 (357 according to the Aluminum Association designation) with 7% silicon and 0.6% magnesium modified with strontium with a theoretical density of 2.67 was melted. Before casting, the alloy was treated in a ALPUR® ladle with a rotary injection nozzle. One part of the alloy was treated with pure argon, and two other parts were treated with argon with 10% hydrogen (by volume) added, at two different rates. Both parts were cast in the form of billets with a diameter of 76 mm and a length of 3 m, applying an electromagnetic agitation by means of three-phase traveling-field linear motors according to the PECHINEY patent EP 0439981.

The alloy treated with pure argon had a $d_{80}$ density of 2.64, which corresponds to a volumetric porosity ratio of 1.2%, while the alloy treated with the argon-hydrogen mixture at the lowest rate had a $d_{80}$ density of 2.52, which corresponds to a porosity ratio a of 5.6%, and that treated with the mixture at the highest rate had a 5.6%, and that treated with the mixture at the highest rate had a do density of 2.23, or a porosity ratio a of 16.5%.

Ten blanks with a height of 110 mm were taken from a billet of an alloy treated with pure argon and 10 blanks were taken from each of the billets of the alloy treated with the argon-hydrogen mixture at the two rates, with each blank corresponding to the quantity of metal required for the pressure injection of a test piece. The blanks were reheated to a temperature of 578° C. for 9 min in an induction furnace so as to reach a liquid fraction ratio of 50%.

The rheologic tests carried out on these blanks showed an average value of the ratio $F/F_s$ at 8% metal loss equal to 0.355 for the metal treated with argon, and equal to 0.20 for the metal treated with the argon-hydrogen mixture at a low rate and 0.15 for the metal treated with the mixture at a higher rate, which represents quite a substantial reduction in apparent viscosity.

In blanks derived from the same billets, reheated under the same conditions as before and air-cooled to the ambient temperature, the volumetric porosity p (in %) was measured by image analysis. The samplings were taken at the mid-height of the blank over surfaces of 110 $mm^2$, centered on the axis of the blank, at mid-radius and at 10 mm from the edge, respectively. For each area examined, 3 groups of 8 measurements were taken, each offset by an angle of 120° so as to eliminate any bias due to possible segregations. The images of the micrographs obtained were analyzed, using the IBAS analysis software by KONTRON, with a resolution <10 $\mu$m, with the porosities corresponding to the black parts. The results were the following:

| p | 10 mm from edge | mid-radius | axis |
|---|---|---|---|
| without $H_2$ | 1.9 | 1.8 | 1.7 |
| low $H_2$ | 4.1 | 4.4 | 4.8 |
| high $H_2$ | 4.5 | 6.2 | 7.1 |

Ten blanks from each of the first two types of billets (without $H_2$ and with a low rate of $H_2$) were reheated under the same conditions as before and pressure-injected into tensile test pieces in the form of ingots with a diameter of 19 mm, at a the final injection pressure of 100 MPa. Test pieces with a diameter of 13.8 mm and an initial length between reference marks of 70 mm were machined from the cast ingots and the following mechanical properties were measured in accordance with the standards NF EN 10002-1 and NF A 57102: tensile strength $R_m$ (in MPa), conventional yield strength at 0.2% elongation $R_{0.2}$ (in MPa) and elongation at rupture A (in %). The results were the following:

| Alloy treated with Ar | | | |
|---|---|---|---|
| Test Piece | $R_m$ | $R_{0.2}$ | A |
| 1 | 350 | 299 | 10.0 |
| 2 | 352 | 306 | 8.7 |
| 3 | 349 | 301 | 10.3 |
| 4 | 354 | 309 | 8.9 |
| 5 | 340 | 301 | 3.6 |
| 6 | 355 | 304 | 8.7 |
| 7 | 347 | 313 | 2.9 |
| 8 | 340 | 307 | 2.4 |
| 9 | 353 | 306 | 8.1 |
| 10 | 351 | 302 | 8.7 |
| Average | 349.1 | 303.8 | 7.2 |
| Standard Deviation | | | 2.87 |

| Alloy treated with Ar + $H_2$ | | | |
|---|---|---|---|
| Test Piece | $R_m$ | $R_{0.2}$ | A |
| 1 | 351 | 309 | 6.1 |
| 2 | 346 | 300 | 8.6 |
| 3 | 351 | 305 | 10.0 |
| 4 | 346 | 293 | 10.7 |
| 5 | 358 | 318 | 7.0 |
| 6 | 351 | 304 | 8.7 |
| 7 | 348 | 301 | 8.3 |
| 8 | 350 | 304 | 7.7 |
| 9 | 350 | 303 | 11.0 |
| 10 | 351 | 304 | 9.7 |
| Average | 350.2 | 304.1 | 8.8 |
| Standard Deviation | | | 1.51 |

It is noted that with the samples of the alloy treated with hydrogen, the average of $R_m$ and $R_{0.2}$ is slightly greater and the average elongation is sharply higher. On the other hand, the dispersion of the elongations, measured by the standard deviation, is quite sharply reduced.

In order to verify the weldability of the alloy treated with hydrogen, MIG and TIG welding tests were carried out. Tensile test pieces identical to those used to measure the mechanical properties were welded to plates derived from sheets of alloy 6061. Micrographic observation of the welded joints established that the welding bead and the heat-affected area of the alloy treated with hydrogen showed no difference in porosity as compared to the non-gassed alloy. In both cases, the quality of the weld was very good and in this respect corresponded to class 1 of the French standard NF 89-220.

What is claimed is:

1. A semi-solid metal alloy mass for semi-solid forming which has been subjected in a liquid state to a controlled treatment with a gas which is soluble in the mass in the liquid state but non-reactive therewith, and subsequently cooled to have a liquid fraction of between 30 and 70% by volume and a porosity ratio p of between 2 and 20%, the porosity ratio p being determined by cooling the alloy mass to ambient temperature and measuring porosity by image analysis at mid-distance between a center of the cooled mass and an external surface of the cooled mass.

2. A semi-solid metal alloy mass for semi-solid forming cast from a liquid metal which has been subjected to a controlled treatment with a gas which is soluble in the mass in the liquid state but non-reactive therewith, and subsequently cooled to have a gassing level, measured by a solidification test under 80 hPa, such that the mass has a volumetric porosity ratio $a=(d_{th}-d_{80})/d_{th}$ between 3 and 50%.

3. The mass according to claim 2, wherein the volumetric porosity ratio is less than 25%.

4. The mass according to claim 1, wherein the porosity ratio p is between 3 and 8%.

5. The mass according to claim 1, wherein the alloy is an aluminum alloy.

6. The metal alloy mass according to claim 1, derived from a solid semifinished product and for the measurement of the porosity ratio p, the semifinished product is reheated to the semisolid state to a temperature such that its liquid fraction is between 30 and 70%, for a time t (in min) such that $t=2.56\ (V/S)^2$, V and S, respectively, being the volume and the surface area of the mass expressed in $cm^3$ and $cm^2$.

7. The mass according to claim 6, in the form of a cylindrical blank with a diameter D and the reheating time is $t=0.16\ D^2$, D being expressed in cm.

8. The mass according to claim 2, wherein the volumetric porosity ratio a is between 4 and 25%.

9. The mass according to claim 2, wherein the metal alloy is an aluminum alloy.

10. The mass according to claim 2, in the form of a billet intended for thixoforming.

* * * * *